US006129397A

United States Patent [19]

Borg

[11] Patent Number: 6,129,397

[45] Date of Patent: Oct. 10, 2000

[54] SIX PACK CARRIER

[75] Inventor: James C. Borg, Eugene, Oreg.

[73] Assignee: Oregon Precision Industries, Eugene, Oreg.

[21] Appl. No.: 09/115,705

[22] Filed: Jul. 15, 1998

[51] Int. Cl.[7] ..... B65D 71/00

[52] U.S. Cl. ..... 294/87.2; 206/151; 206/161

[58] Field of Search ..... 294/87.2, 87.28, 294/159; 206/139, 143, 145, 147–151, 158, 159, 161, 162, 199, 201, 427; 215/396; D9/434, 455

[56] References Cited

U.S. PATENT DOCUMENTS

| | | | |
|---|---|---|---|
| Re. 35,288 | 7/1996 | Borg . | |
| 3,002,612 | 10/1961 | Poupitch | 294/87.2 X |
| 3,036,853 | 5/1962 | Glazer | 294/87.2 |
| 3,261,498 | 7/1966 | Erickson . | |
| 3,633,962 | 1/1972 | Erickson . | |
| 4,093,295 | 6/1978 | Erickson . | |
| 4,159,841 | 7/1979 | Calvert | 294/87.2 |
| 4,235,468 | 11/1980 | Erickson . | |
| 4,247,142 | 1/1981 | Erickson . | |
| 4,249,766 | 2/1981 | Erickson . | |
| 4,448,452 | 5/1984 | Wood | 294/87.2 |
| 4,471,987 | 9/1984 | Erickson . | |
| 4,484,774 | 11/1984 | Moss | 294/87.2 |
| 4,523,677 | 6/1985 | Schurmann | 294/87.2 X |
| 4,634,002 | 1/1987 | Delonghi | 294/87.2 X |
| 5,346,271 | 9/1994 | Erickson . | |
| 5,480,204 | 1/1996 | Erickson | 294/87.2 |
| 5,735,562 | 4/1998 | Borg . | |

*Primary Examiner*—Johnny D. Cherry
*Attorney, Agent, or Firm*—Chernoff, Vilhauer, McClung & Stenzel, LLP

[57] ABSTRACT

An integral carrier for carrying multiple containers by their necks has a substantially planar web defining a pair of centrally located annular support openings. Each support opening is surrounded by a support rib having a radiused inner surface. A plurality of annular neck-engaging structures is integral with the web and arranged around the periphery of the support openings. Each of the neck-engaging structures has a respective circumferential rib and a plurality of flanges projecting inwardly from the circumferential rib for releasably engaging the necks of the containers. At least two interior ribs each extend between one of the support ribs and one of the plurality of neck-engaging structures.

10 Claims, 3 Drawing Sheets

SIX PACK CARRIER

BACKGROUND OF THE INVENTION

Six-pack or multiple bottle carriers which hold bottles or containers by their necks to allow them to be carried are well known. The bottles typically have labels to advertise their liquid contents. A common type of commercially available prior art carrier is fabricated from thin gauge sheets of plastic. The thin planar sheet is die-cut to provide holes for engaging the necks of the containers and holes for grasping the carrier, and is thermo-formed into a three dimensional shape to provide structural integrity to the carrier. There are several problems with this carrier. First, the thermo-formed plastic sheet shrouds the container, obscuring visibility of the product and product labels. Second, the thin gauge of the plastic material makes the carrier uncomfortable to carry. Further, the thin gauge material requires a substantial amount of structural surface area to support the containers. This tends to further hide the product in the containers and advertising on the labels.

Another carrier design is disclosed in U.S. Pat. No. 3,633,962. It has keyhole-shaped neck retainers and sharp edges on both the neck retainers and the finger holes. This carrier is also uncomfortable to carry due to its sharp edges. In addition, the rigid keyhole-shaped neck retainers are difficult to fit over the neck flanges of the containers, and likewise it is difficult to remove the containers from the carrier due to the rigid key hole-shaped neck retainers.

What is needed is a carrier that is comfortable to carry, allows for excellent visibility of the product in the containers and the labels on the containers and further allows for easy application and removal of the containers from the carrier.

SUMMARY OF THE INVENTION

The present invention comprises an integrally-molded carrier for carrying multiple containers by their necks. The carrier has a substantially planar web defining a pair of centrally located annular support openings. Each support opening is surrounded by a support rib having a radiused inner surface. The carrier has a plurality of annular neck-engaging structures integral with the web and arranged around the periphery of the support openings. Each of the neck-engaging structures has a respective circumferential rib and a plurality of flanges projecting inwardly from the circumferential rib for releasably engaging the necks of the containers. In addition, the carrier has at least two interior ribs, each extending between one of the support ribs and one of the plurality of neck-engaging structures.

DETAILED DESCRIPTION OF THE PREFERRED EMBODIMENT

Figure 1:
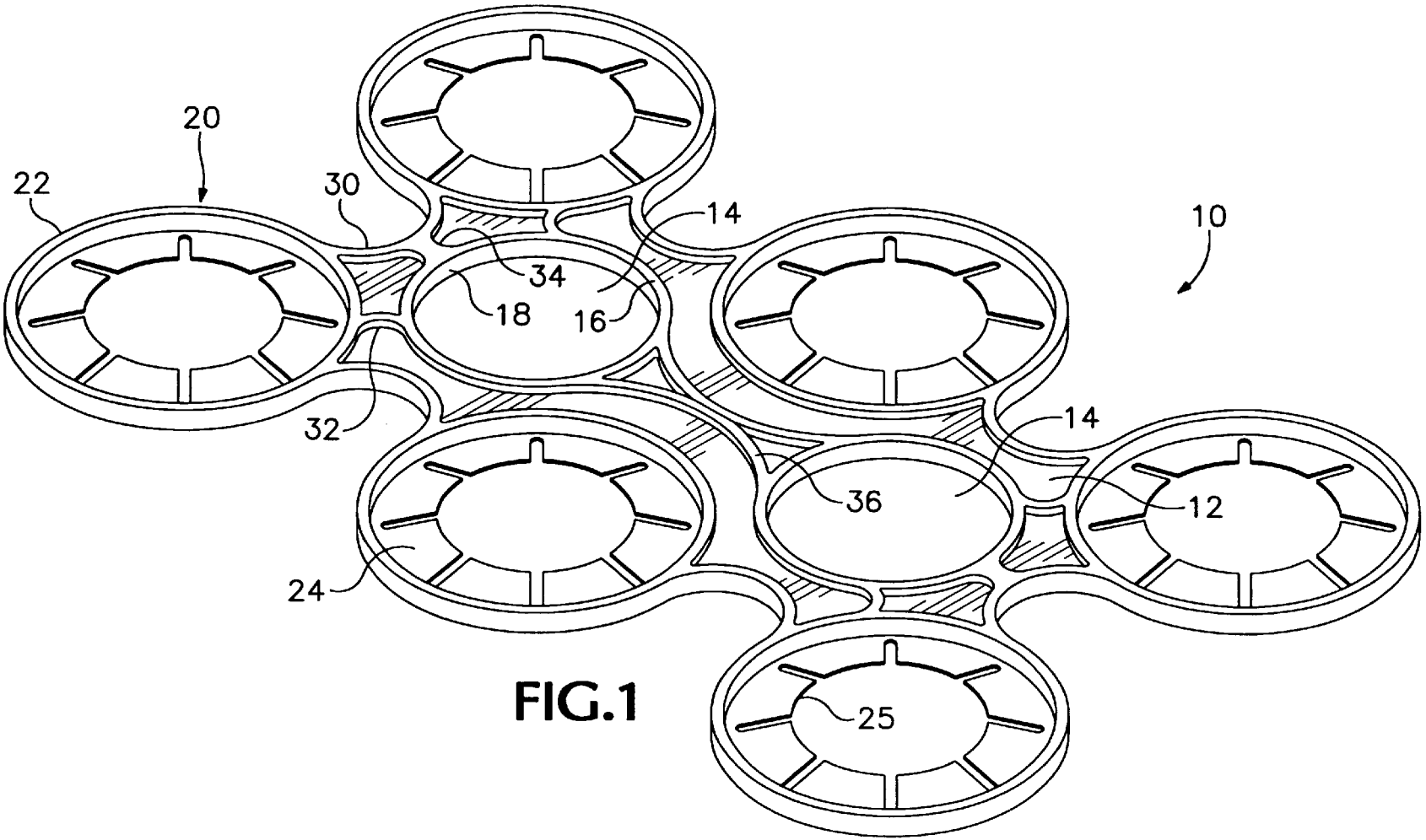
FIG. 1 is a perspective view of an exemplary integral carrier of the present invention.
Figure 3:
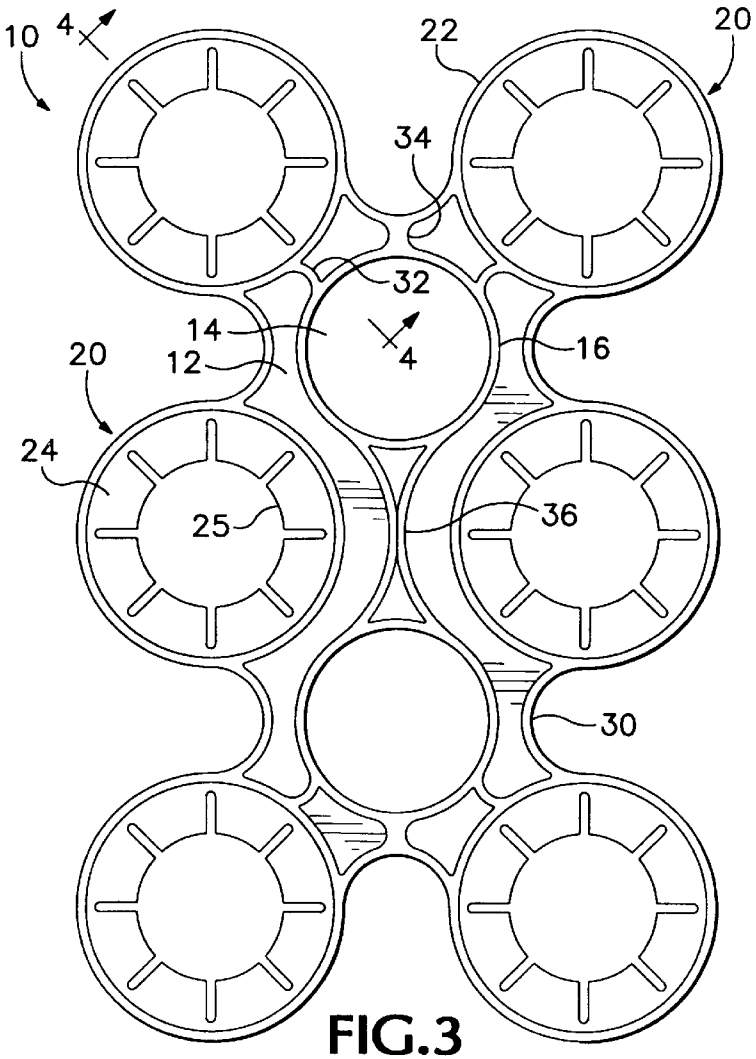
FIG. 3 is a top view of the carrier shown in FIG. 1.
Figure 2:
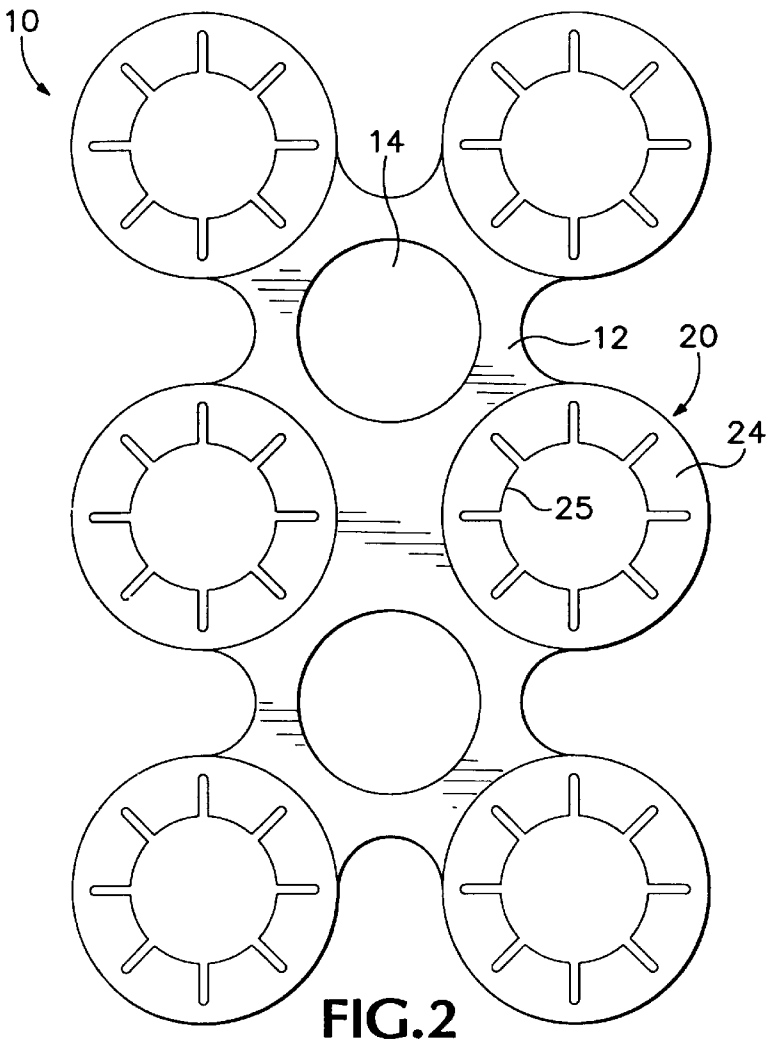
FIG. 2 is a plan view of the carrier of FIG. 1 viewed from the bottom.
Figure 4:
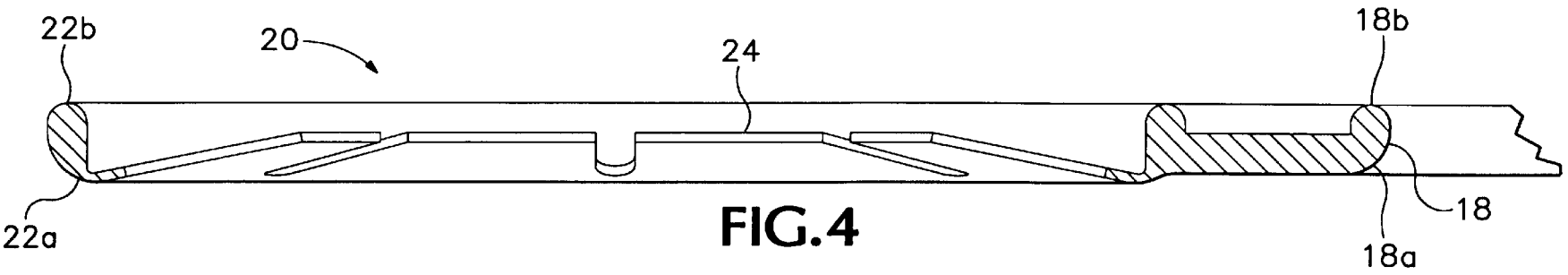
FIG. 4 is a sectional view taken through plane A—A of FIG. 3.

Referring to the drawings, wherein like numerals refer to the same elements, there is shown in FIGS. 1–5 an integral carrier 10 for carrying multiple containers. Carrier 10 has a web 12 that is substantially planar. Web 12 has a pair of centrally located annular support openings 14. Each support opening is surrounded by a support rib 16 preferably having a radiused inner surface 18. Surfaces 18*a* and 18*b* are preferably radiused to provide comfortable gripping surfaces for carrying the carrier.

A plurality of identical annular neck-engaging structures 20 are integral with the web 12 and are arranged around the periphery of the support openings 14. Each neck-engaging structure 20 has a respective circumferential rib 22. Each circumferential rib 22 has a radiused upper and lower surface 22*b* and 22*a,* respectively. Each neck-engaging structure 20 further has a plurality of flanges 24 projecting inwardly from the circumferential rib 22 for releasably engaging the necks 26 of the containers 28. The flanges 24 are oriented upwardly and comprise sections of a truncated cone. The inner edges 25 of flanges 24 form a circle. The inner edges of the flanges engage the necks 26 of the containers 28, allowing carrier 10 to secure and support the containers.

Interconnecting each of the neck-engaging structures 20 are external ribs 30. External ribs 30, like support ribs 16 and circumferential ribs 22, have radiused upper and lower surfaces. Internal ribs 32 and 34 respectively interconnect circumferential ribs 20 and external ribs 30 with annular support ribs 16. Internal ribs 32 and 34 preferably also have radiused upper surfaces. Two central ribs 36 extend between the support ribs 16. Central ribs 36 preferably have radiused upper surfaces. Internal ribs 32 and 34 and central ribs 36 extend upwardly from the surface of web 12. These interconnecting ribs add dimensional support to the carrier, much like cross beams in a framed structure.

In a preferred embodiment, the thickness of flanges 24 is 20–25 mils, the thickness of both ribs and web 12 is 60 mils, and the height of the ribs 16 and 32 and web 12 combined is 120 mils. In a preferred embodiment, support ribs 16 surrounding the support openings 14 and external ribs 30 interconnecting the neck-engaging structures 20 have the same radius.

The carrier 10 is manufactured using high pressure injection molding of heated and liquified polymer into a three-dimensional cavity. Carrier 10 is preferably made of a flexible material such as a polyolefin. In a most preferred embodiment, the polyolefin is high density polyethylene that has a tensile strength from about 4000 to about 5000 psi, a flexural strength of at least 65 psi and a brittleness temperature of less than −50° C. This material is easily recyclable, in contrast to the material used to make conventional die-cut thermo-formed carriers. Interconnecting ribs 32, 34 and 36 aid in the injection molding of the carrier. In the mold, the spaces which will eventually be filled with polymer to form these ribs provide flow channels for the polymer during fabrication of the carrier. This allows polymer to freely flow into the circumferential ribs 22 from a centrally located injection gate.

The carrier of the present invention concentrates structure into three-dimensional ribs, thereby reducing the surface area required to support containers. At the same time, this minimal surface area provides for a quality appearance while utilizing less material. The carrier is essentially planar and so does not obscure the container or product therein or labels, but instead provides high product and label visibility.

In addition, the thick ribs and radiused edges of the ribs provide superior comfort for lifting and carrying the carrier and for removing the containers from the carrier. Unlike currently available carriers, inner surface 18 has smooth radiused upper and lower surfaces 18*a* and 18*b* which are gripped when the carrier is grasped. And the smooth radiused edges of circumferential ribs 22 provide superior comfort when the carrier is grasped to remove a container.

The carrier also provides superior release of the containers. The circumferential ribs around the angled, thin conical flanges provide support for the containers. The thin flanges easily flex to allow the containers to be removed by either lifting the carrier relative to the container or pulling the container down and away from the carrier.

EXAMPLE

A carrier of substantially the same design shown in FIGS. 1–5 was fabricated by injection molding from high density polyethylene having a specific gravity of 0.962, with a tensile strength of 4800 psi (33 mpa), a flexural strength of 7000 psi (48 mpa) and a brittleness temperature of approximately −100° C. Flanges 24 of the neck-engaging ring structure 20 had a gauge of 22 mils, web 12 had a gauge of 60 mils and ribs 32 and 36 had a gauge of 60 mils. The combined gauge of the ribs and web was 120 mils.

Figure 5:
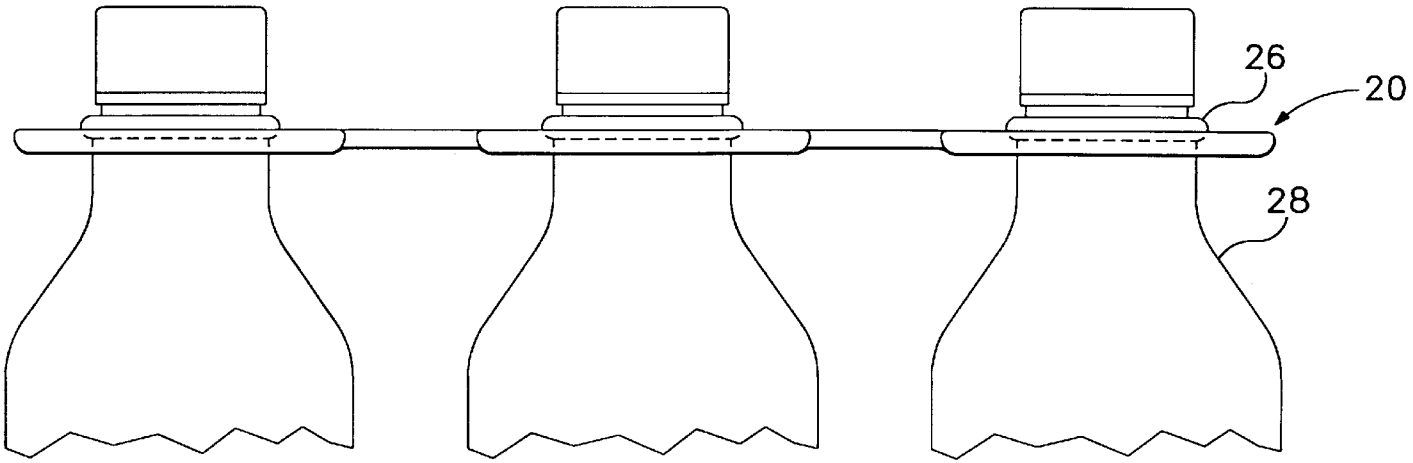
FIG. 5 is a side view of the carrier of FIG. 1 shown in place on multiple containers.

The so-fabricated carrier was easily and quickly secured over the annular flanges of six 12-ounce liquid filled containers each by placing the neck-engaging structures 20 over the bottle caps and necks and pushing them down until the flanges 24 of the neck-engaging structures engaged the annular flanges 26 on the necks of the containers as illustrated in FIG. 5. The carrier secured and supported the containers, yet readily disengaged by simply pulling the containers downward and away from the carrier.

The same basic neck-engaging structures may be incorporated into other multiple container carriers, such as carriers for fewer or more than six containers.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An integrally molded carrier for carrying multiple containers by their necks, comprising:

(a) a substantially planar web having a top surface and a bottom surface, said web defining a pair of centrally located annular support openings, each support opening being surrounded by a support rib having a smooth radiused inner surface extending between said top surface and said bottom surface so that said inner surface is free from a sharp edge;

(b) a plurality of annular neck-engaging structures integral with said web and arranged around the periphery of said support openings, each of said neck-engaging structures having a respective circumferential rib and a plurality of flanges projecting inwardly from said circumferential rib for releasably engaging the necks of the containers; and (c) at least two interior ribs, each extending between one of said support ribs and one of said plurality of neck-engaging structures.

2. The carrier of claim 1 wherein each of said neck-engaging structures is interconnected to an adjacent neck-engaging structure with an external rib on the periphery of said web.

3. The carrier of claim 1 wherein said support ribs are annular.

4. The carrier of claim 1 wherein said plurality of flanges are oriented upwardly and comprise sections of a truncated cone when said carrier is not applied to any containers.

5. The carrier of claim 1 which is formed of a flexible material.

6. The carrier of claim 5 wherein said flexible material is a polyolefin.

7. The carrier of claim 6 wherein said polyolefin is recyclable high density polyethylene.

8. The carrier of claim 1 wherein each said respective circumferential rib has a smooth radiused outer surface extending between a top surface and a bottom surface of said flanges so that said outer surface is free from a sharp edge.

9. The carrier of claim 1 wherein each of said plurality of flanges projecting inwardly from said circumferential rib for releasably engaging the necks of the containers is oriented upwardly.

10. The carrier of claim 1 wherein each respective circumferential rib is connected to an adjacent circumferential rib by a single interconnecting rib.

* * * * *